US006688236B2

(12) United States Patent
Taillon

(10) Patent No.: US 6,688,236 B2
(45) Date of Patent: Feb. 10, 2004

(54) FRICTION WEDGE DESIGN OPTIMIZED FOR HIGH WARP FRICTION MOMENT AND LOW DAMPING FORCE

(75) Inventor: Armand P. Taillon, Chicago, IL (US)

(73) Assignee: Standard Car Truck Company, Park Ridge, IL (US)

( * ) Notice: Subject to any disclaimer, the term of this patent is extended or adjusted under 35 U.S.C. 154(b) by 188 days.

(21) Appl. No.: 09/772,275

(22) Filed: Jan. 29, 2001

(65) Prior Publication Data

US 2001/0054368 A1 Dec. 27, 2001

Related U.S. Application Data

(63) Continuation of application No. 09/306,300, filed on May 6, 1999, now Pat. No. 6,269,752.

(51) Int. Cl.[7] ..... B16F 5/12

(52) U.S. Cl. ..... 105/198.2; 267/3; 267/209; 105/198.4

(58) Field of Search ..... 267/205, 206, 267/209, 211, 212, 213, 216, 3, 4, 6; 105/197.05, 199.1, 198.4, 198.2, 453

(56) References Cited

U.S. PATENT DOCUMENTS 3,977,332 A * 8/1976 Bullock ..... 105/197 DB
4,109,585 A * 8/1978 Brose ..... 105/197 DB
4,244,298 A * 1/1981 Hawthorne et al. ..... 105/197 D
4,276,833 A 7/1981 Bullock
4,765,251 A * 8/1988 Guins ..... 105/197.05
5,072,673 A 12/1991 Lienard
5,555,818 A * 9/1996 Bullock ..... 105/198.2
5,943,961 A * 8/1999 Rudibaugh et al. ..... 105/198.2

OTHER PUBLICATIONS

U.S. patent application, Ser. No. 09/306,300, filed May 6, 1999; Armand P. Taillon, inventor.

* cited by examiner

*Primary Examiner*—Jack Lavinder
*Assistant Examiner*—Bradley King
(74) *Attorney, Agent, or Firm*—Cook, Alex, McFarron, Manzo, Cummings & Mehler, Ltd.

(57) ABSTRACT

A damping system for a rail car truck utilizes friction wedges supported on side springs to damp relative movement between the rail car truck bolster and the side frames supporting it. Each friction wedge has a generally triangular shape with an angle θ defined between a vertical friction surface which bears against a side frame and a sloping friction surface which moves relative to the bolster. The angle θ and the force P of each side spring are defined by $$Fw_{W.E} = \frac{-P}{2} \cdot \frac{(\cos(\theta) + \mu_{2w} \cdot \sin(\theta))}{(\mu_{1w} \cdot \cos(\theta) + \mu_{1w} \cdot \mu_{2w} \cdot \sin(\theta) + \mu_{2w} \cdot \cos(\theta) - \sin(\theta))} \cdot \frac{2 \cdot a \cdot w_w}{[b \cdot (a \cdot w_w)]}$$

$$V_{c.w.E} = 2 \cdot \mu_{1d} \cdot P \cdot \frac{(\cos(\theta) - \mu_{2d} \cdot \sin(\theta))}{(-\mu_{1d} \cdot \cos(\theta) + \mu_{1d} \cdot \mu_{2d} \cdot \sin(\theta) + \mu_{2d} \cdot \cos(\theta) + \sin(\theta))}$$

6 Claims, 4 Drawing Sheets

Fig.4A.
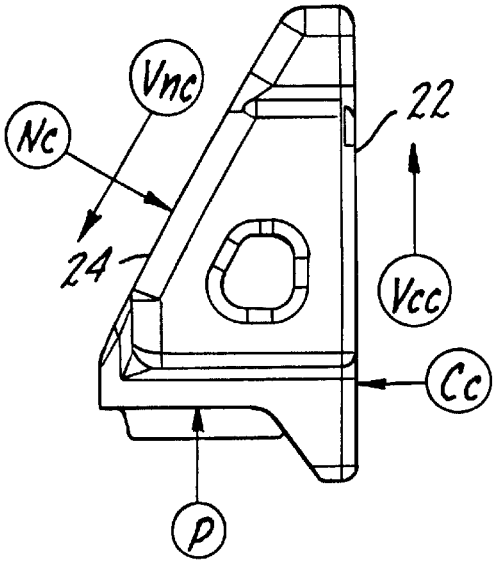
Fig.4B.
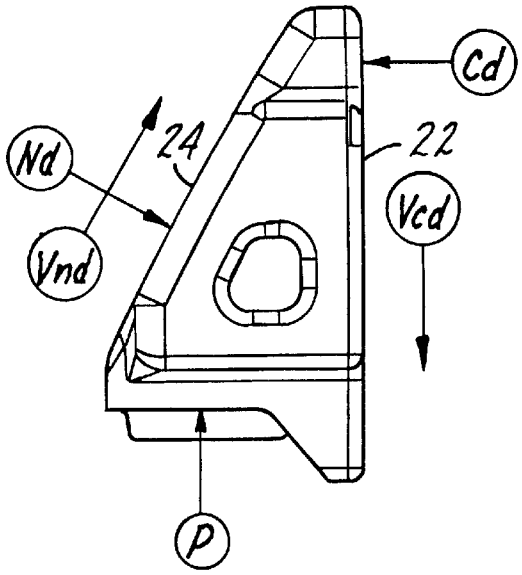
Fig.4C.
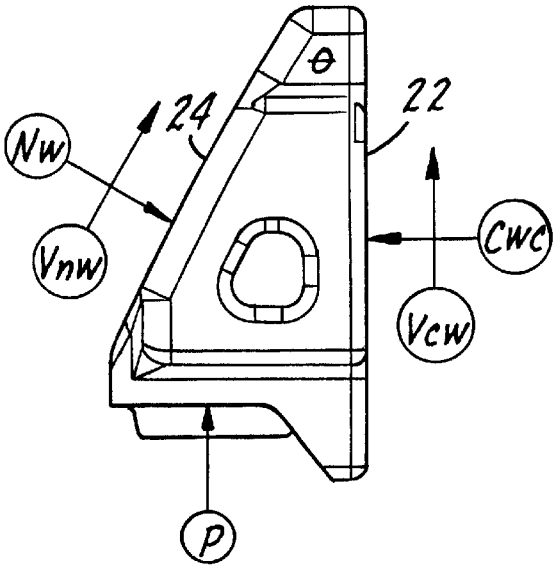
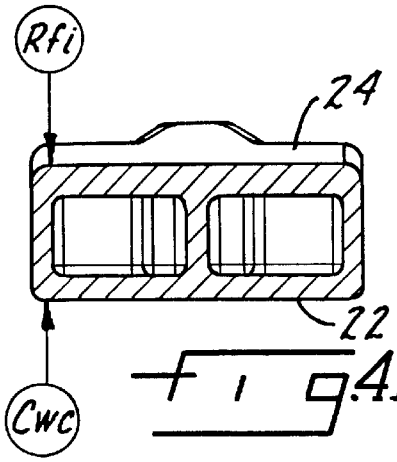
Fig.4D.

Fig.5A.
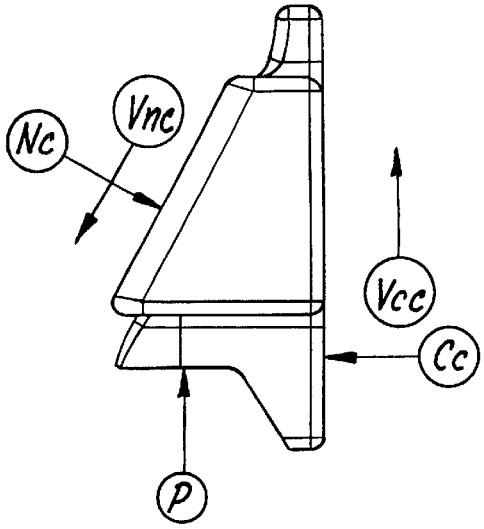
Fig.5B.
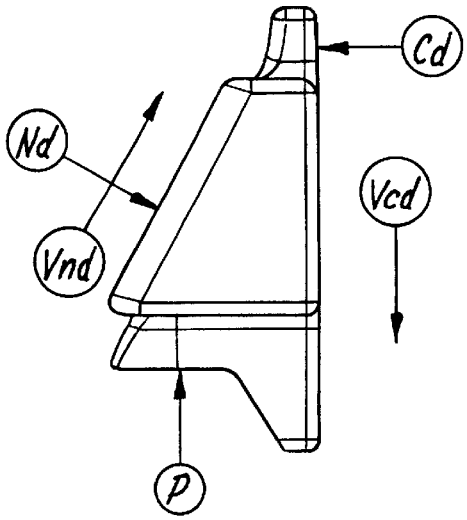
Fig.5C.
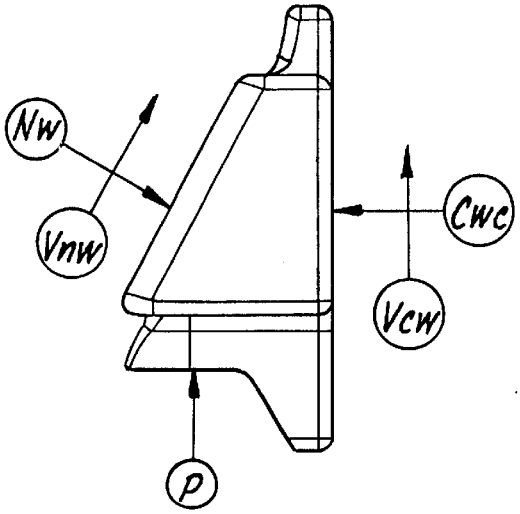
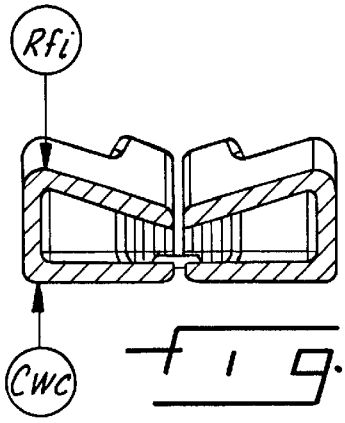
Fig.5D.

FRICTION WEDGE DESIGN OPTIMIZED FOR HIGH WARP FRICTION MOMENT AND LOW DAMPING FORCE

This is a continuation of application Ser. No. 09/306,300, filed May 6, 1999 now U.S. Pat. No. 6,269,752.

FIELD OF THE INVENTION

The present invention relates to "three-piece" railroad car trucks, and more particularly to the four friction wedges that interface the bolster with the side frame and provide suspension damping and warp stiffness. Warp friction moment, the measure of interaxle shear moment necessary to produce truck warp, is the primary characteristic that governs truck warp stiffness, and it is a characteristic that three-piece trucks are known to be deficient in. Damping force levels, on the other hand, have not been a problem to achieve in any magnitude desired, but are a problem if they are too low or too high. The present invention teaches the desired relationship between friction wedge angle, friction coefficient, wedge spring force, and wedge width to provide a friction wedge that will simultaneously produce a very high to infinite warp friction moment with a moderate to low damping force.

By increasing the warp friction moment, higher interaxle shear stiffness, or truck warp stiffness can be achieved. Warp stiffness, is the primary characteristic of two axle trucks that determines high-speed stability and heavy axle load curving performance. Static warp friction moment, commonly described as the warp friction moment, is the friction force couple, produced primarily by the friction wedge, in resistance to truck warp forces or interaxle shear forces. It is called the static warp friction moment, because the resistance moment produced by the wedges is limited by static friction. It is the objective of the present invention to increase the warp stiffness of the three-piece truck by increasing the warp friction moment through an optimization of the friction wedge design.

In the present invention, by simultaneously equating the warp friction force with the maximum interaxle shear force, and the damping force to a percentage of the sprung weight, it is possible to achieve a friction wedge design that both resists truck warp, and maintains a safe level of suspension damping. The use of a pair of simultaneous equations enables the design engineer to produce a friction wedge design based on the maximum warp friction moment and damping rate desired, rather than on the basis of the damping rate alone. The result of the equations is a set of parameters for the complete design of a friction wedge and a side spring optimized for warp friction and damping.

BACKGROUND OF THE INVENTION

In North American freight railroad service, conventional three-piece freight car trucks, having two wheelsets, have evolved to satisfy a variety of important operating and economic requirements. Among other requirements, they must be capable of safely supporting, and equalizing very high wheel loads over a wide range of track conditions while delivering a high level of economic value to the railroads that use them. In addition to those basic criteria, the trucks and their parts must be interchangeable throughout the system of interconnected railroad networks. The three-piece trucks in service today have, to a large extent, met these requirements, because their general designs are simple, flexible, durable, and reliable. However, in this evolutionary process, a major aspect of truck design for performance efficiency has been largely ignored, design for warp friction moment.

When a conventional three-piece truck encounters sufficient energy in the course of its normal use, usually due to high-speed operation, the wheelsets are forced to move laterally relative to the track and relative to one another causing the instability known as "truck hunting". Truck hunting is undesirable, because it causes high lateral forces to be imparted to the rail vehicle and its lading, and because it produces increased drag on the locomotive, resulting in reduced efficiency. Likewise, when a conventional three-piece truck encounters a curve in the normal course of its use, the wheelsets are often forced to move laterally relative to one another resulting in a condition known as "truck warp". Truck warp is undesirable, because it causes a high angle of attack to arise between the leading wheelset and the rail, resulting in high rates of wear on the rails and wheels. Whether they are a result of high speed or curving, truck hunting and truck warp are generally characterized by a lateral displacement of the wheelsets relative to one another, and a change of the square relationship of the side frames relative to the bolster into an angular relationship.

Testing of conventional three-piece freight car trucks involved in heavy axle load derailments has shown that a large proportion of the interaxle shear stiffness that governs their performance is attributable to the side frame to bolster connection. However, current designs of this connection have an inherent problem in that they only provide resistance to unsquaring movements between the side frames and bolster up to the limit of the coulomb friction force that binds these connections. Recent theoretical modeling, and laboratory testing have confirmed that the warp friction moment is the critical determining factor in the performance of the three-piece truck.

The side frame to bolster connection design of three-piece trucks is generally characterized by a right triangle shaped friction wedge in contact with and contained by a pocket in the bolster on one side, a vertical surface of the side frame on another, and a spring on the third side. The connection is comprised of three load bearing interfaces: the Spring Seat Surface, the Slope Surface, and the Column Surface. The wedge surfaces are oriented in the shape of a right triangle with the spring seat and column surface oriented at a right angle to each other, and the slope surface oriented at an acute angle to the column surface. The wedge is oriented with the column surface vertically to allow sliding motion of the bolster relative to the side frame due to dynamic forces of the rail vehicle body. The wedge slope surface bears on the bolster pocket slope surface, which acts to direct the force of the spring from the spring seat surface into the column surface. As a result of the wedge configuration and orientation, a force balance is formed on the friction wedge, at the three interfaces, that is governed by the relative position and movement of the bolster to the side frame.

Three different force balances are possible: the spring Compression Stroke force balance, the spring Decompression Stroke force balance, and the truck Warp Action force balance. The compression and decompression stroke force balances are the force balances that describe the coulomb damping forces in the three-piece truck, and they have been used for many years by design engineers to design friction wedges for vertical damping. These two force balances are governed by the wedge angle, the spring force, and the coefficients of friction between the materials of the wedge and the column and slope surfaces respectively. The warp action force balance describes the forces that act on the wedge under interaxle shear force conditions, and it gets its name from the interaxle shear or truck warp forces that generate the wedge forces. Under warp action, the friction forces that otherwise act in opposite directions, act upward in the same direction, and bind the wedge between the column and side frame up to the limit of the static friction forces at those interfaces.

The warp action force balance that describes the warp action forces on the wedge is new, and has neither been described in the prior art nor publication literature. It was discovered through a parameter effect analysis of the wedge force balance parameters. The objective of the analysis was to determine the effect on the damping force of the governing parameters: wedge angle, friction coefficient, and spring force. The analysis revealed the exponential nature of the damping force to the wedge angle and friction coefficient. The association of this fact with the fact discovered in the derailment investigations that trucks with smaller wedge angles were much less likely to derail, lead to the discovery that a unique frictional force balance on the wedge must exist under truck warp force conditions.

The expanded parameter analysis revealed the same type of exponential relationship of the warp friction moment to the wedge angle and friction coefficient as the damping force analysis did. This lead to the discovery that, although both the damping force and the warp friction force increased exponentially with decreasing wedge angle and increasing friction coefficient, the warp friction force increased much more rapidly than the damping force. This fact implied the probable existence of a wedge angle and spring force combination that, given a certain friction coefficient, would produce a wedge design with a high warp friction moment and a low damping force.

The probable existence of an "optimum" combination of the essential wedge force balance parameters lead to the development of a model designed to determine the values of the parameters by means of objective inputs. As a result, one object of the present invention is the math model so derived, and entitled, "Method for the Design of a Friction Wedge and Side Spring Optimized for Lateral Warp Friction Moment and Vertical Damping Force". The essence of the model is the warp action force balance combined with the truck warp force balance, in a set of simultaneous equations with the compression damping force balance.

The model uses the basic objective inputs of: wedge width, wedge friction coefficients, and damping ratios; and rail vehicle weights, major truck dimensions, center plate and side bearing friction coefficients, and rail friction coefficient. These inputs can be divided into two groups: one group that describes the friction wedge characteristics, and one group that describes the truck characteristics at the empty and loaded car conditions. Although all the parameters of both groups are defined objectively, one parameter from the wedge group and two parameters from the truck group require some discretion in setting their values in order to achieve the best possible optimized solution. The rail friction coefficient and the center plate (and side bearing) friction coefficient are the primary driving factors of the empty and loaded car warp forces respectively, and the damping ratio is the primary driving factor of the damping forces. Therefore, these three parameters are designed to be determined on the basis of the required level of warp resistance and damping force for the application of the truck.

With the basic input parameters determined, the model produces a solution in terms of the unknown friction wedge, and side spring dimensions: wedge angle, wedge height, wedge depth, and work point; and spring bar diameter, outer diameter, and free height respectively. Together with the inputs such as wedge width, and spring solid height, the model solution provides the exact dimensions for a complete friction wedge and side spring design optimized to produce a predetermined combination of warp friction moment and damping force. In addition to providing the dimensions for these designs, the model also provides an exact solution for the number and type of load springs necessary to design a complete suspension arrangement that is consistent with the wedge and side spring design solution.

As stated above, this model is designed to determine the optimum wedge and spring design solution for any combination of car load, truck size, and wedge material. The discretionary inputs are designed to allow the engineer the flexibility to adjust the input parameters to produce the wedge and spring design solution desired. However, the discretionary inputs are rooted in real terms that have objective definitions. Therefore, an optimum wedge and spring design solution can be found by applying objectively determined versions of the discretionary inputs. When this is done, and some allowance is made for the natural variation inherent in the input parameters, a pattern of wedge design emerges that has a very specific set of ranges of the essential design parameters.

Of all the essential wedge design parameters, the wedge angle is, by definition, the most essential, because it is the dimension that defines the triangular shape of the wedge and has the greatest controllable effect on the damping and warp friction forces. The range of wedge angle that emerges from the completely objective input case lies just below the typical angular range of friction wedge design. In combination with a sufficient wedge width, a moderate wedge friction coefficient, and a certain spring force, the smaller than normal wedge angle becomes a powerful feature for producing a combination of high warp friction moment with low to moderate damping force in one friction wedge and side spring design.

Given this fact, it is the object of this invention, in addition to the claims of the design method model, to claim two preferred embodiments of the friction wedge and spring designed to generally accepted values of the objective inputs described in this application. The two preferred embodiments are to be wedge and spring couples that are designed to the solutions determined by the design method model. The range of wedge and spring couple design is to be determined by generally accepted values of variation of the objective inputs to the model.

SUMMARY OF THE INVENTION

The present invention relates to three-piece freight car trucks and in particular to a three-piece freight car truck that increases warp stiffness.

Another purpose of the invention is a freight car truck design having increased interaxle shear stiffness while limiting coulomb damping forces to moderate levels.

Another purpose of the invention is a mathematical method for producing the design of a friction wedge and side spring that are optimized for sufficient warp friction moment and limited damping force.

Another purpose of the invention is a freight car truck design with friction wedges specially designed, as either a one piece wedge or a two piece split wedge, to increase interaxle shear stiffness by increasing the warp friction moment they produce.

Another purpose of the invention is a friction wedge with a wedge angle in the range of 28° to 32° as determined by the design method disclosed herein.

Another purpose of the invention is a freight car truck design with side springs specially designed to produce an optimal magnitude of force at empty and loaded car condition so that the warp friction moment is sufficiently high while the damping force is sufficiently low.

Other purposes will appear in the ensuing specification, drawings and claims.

DESCRIPTION OF THE DRAWINGS

The invention is illustrated diagrammatically in the following drawings wherein:

FIGS. 4A, 4B, 4C and 4D are side views and a section respectively of a friction wedge showing the forces applied thereto during truck use; and FIGS. 5A, 5B, 5C and 5D are side views and a section respectively illustrating the forces applied to a split friction wedge during use in a rail car truck.

DESCRIPTION OF THE PREFERRED EMBODIMENT

Figure 1:
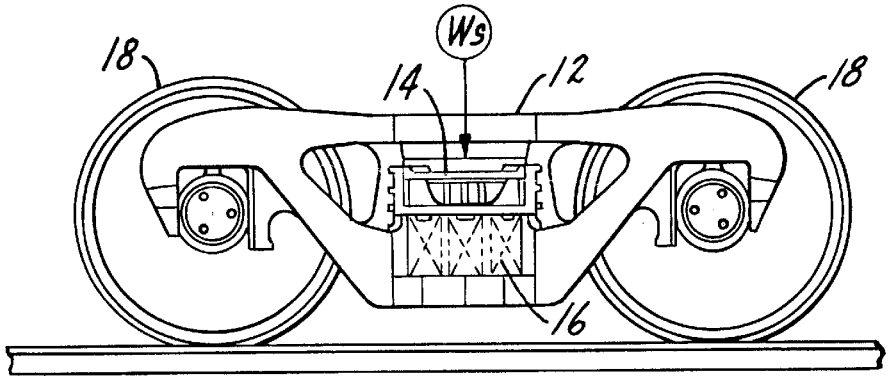
FIG. 1 is a side view of a rail car truck illustrating the design of the present invention.

The present invention relates to freight car trucks and specifically to an improved interface between the side frame and the bolster that will improve truck performance in high speed and curving operation. The truck design disclosed herein will increase warp stiffness or interaxle shear stiffness or the resistance to the unsquaring forces which are applied to the truck during operation. The improved interface is a friction wedge and side spring of a design determined by a mathematical method to optimize the balance between the warp friction moment (warp stiffness) and the damping force. A friction wedge and side spring set of a design so derived is the preferred embodiment of this invention.

A friction wedge of optimized design configuration is combined with a side spring designed to impart a correspondingly optimal force at all levels of compression to produce a sufficiently high warp friction moment together with a sufficiently low damping force to produce lateral and vertical stability. A triangular shaped friction wedge is supported from below by one or more coil springs seated on the side frame spring seat, and retained from above and to the side by the bolster pocket slope surface and the side frame column respectively.

In a conventional three-piece freight car truck, the interaxle shear stiffness which controls stability and curving performance is contributed mostly by the side frame to bolster connection by way of the spring forced friction wedge. The problem with the current design of this connection is that it only provides adequate interaxle shear stiffness by means of coulomb frictional resistance up to a threshold or break-away force. At interaxle shear force levels higher than the break-away force the interaxle shear stiffness of the three-piece truck drops to a less than adequate level for good stability and curving.

In particular, the frictional resistance characteristic is comprised of two modes of action, static and kinetic friction. The static mode is characterized by a high stiffness resistance to sliding yaw movement between the side frame and bolster. The static mode is substantially higher in warp resistance force and interaxle shear stiffness than the kinetic mode. The limit of the static mode is defined as the warp friction moment, sometimes referred to as the static warp friction moment. The kinetic mode is characterized by the resistance imposed while the side frame is rotating, in a sliding fashion, in yaw relative to the bolster. At low speeds, and under moderate curving conditions, the static warp friction moment of conventional friction wedges effectively resists relative yaw movement between the side frame and bolster. However, at higher speeds, and under severe curving conditions, the input forces over-power the static mode of frictional resistance, and cause the side frames to slide in kinetic yaw movement relative to the bolster.

By substantially increasing the static warp friction moment of the connection between the side frame and bolster, it is possible to dramatically increase the warp stiffness of the conventional freight car truck. The present invention provides a mathematical method for the design of a friction wedge and side spring that substantially increases the warp friction moment while maintaining a safe level of vertical suspension damping. At the core of the mathematical design method is a pair of fundamental force balances for warp friction force and damping force combined in a system of simultaneous equations to find the optimum combination of friction wedge angle, and the side spring force.

Figure 2:
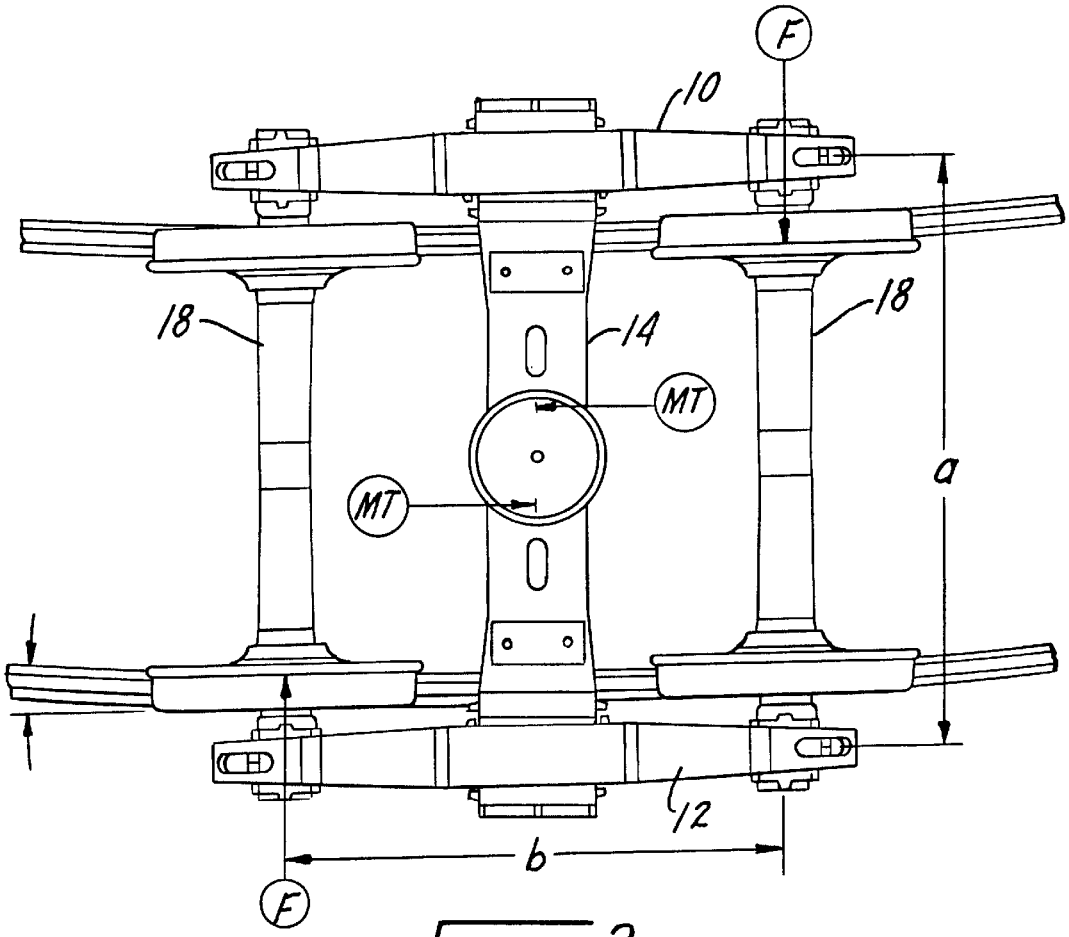
FIG. 2 is a top view in horizontal section, of the rail car truck.

Focus on FIGS. 1 and 2 a rail car truck is shown to include a pair of side frames 10 and 12 connected by a bolster 14. Load springs diagrammatically shown at 16 support the bolster on the side frame and the ends of the side frames are supported on roller bearings located near the ends of the wheel sets indicated generally at 18. The structure described above is conventional in the railroad art.

Figure 3:
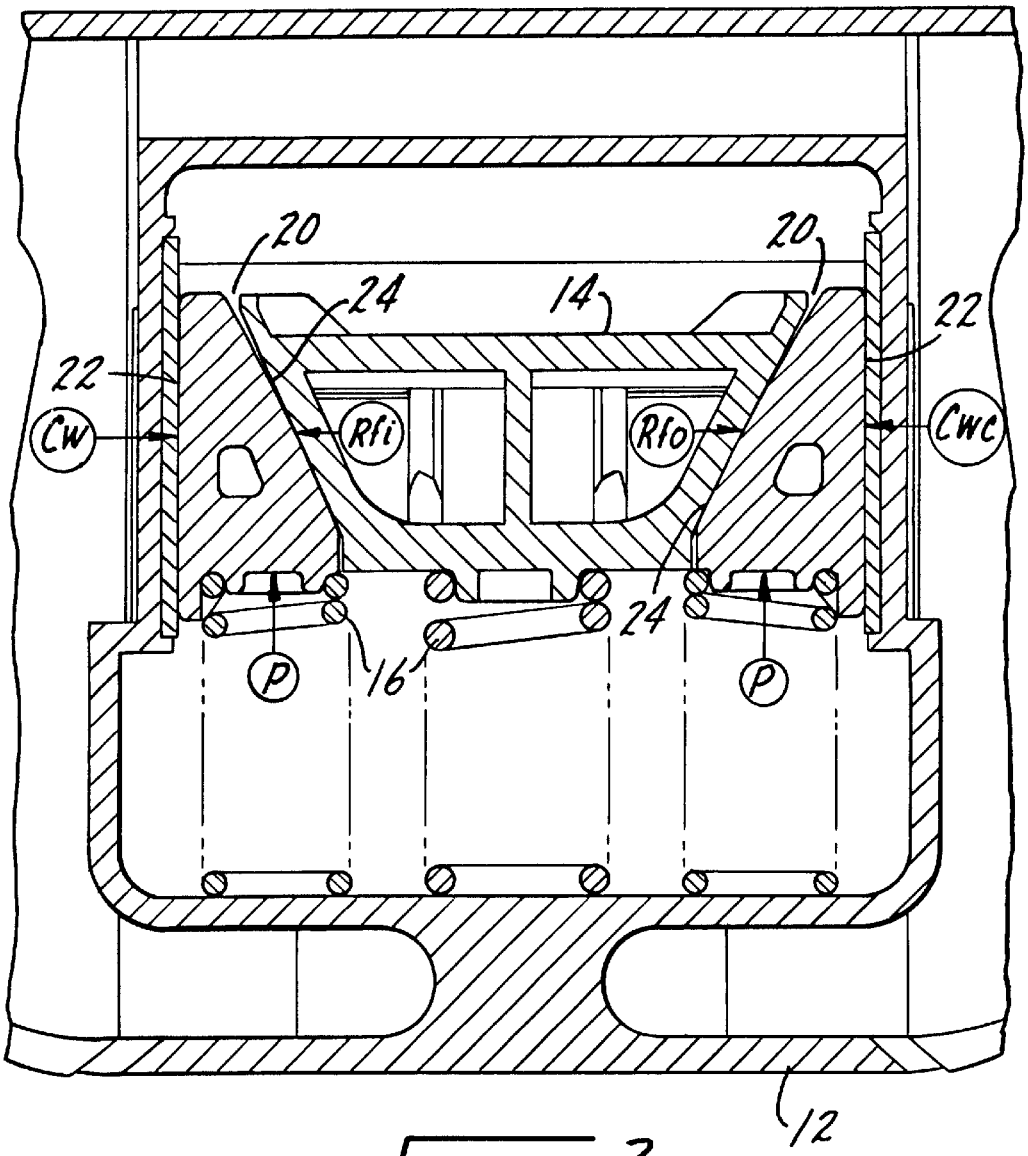
FIG. 3 is an enlarged section illustrating the bolster, side frame, wedge relationship.

Focusing particularly on FIG. 3, the bolster 14 will have pockets 20, at each end thereof, there being two such pockets at each end of the bolster. The pockets will contain the friction wedges which are the heart of the damping system disclosed herein. The friction wedges, as particularly shown in FIGS. 3 and 4A thru 4D, have c column face 22 and a sloping face 24 with the sloping face 24 bearing against the slanted face of the bolster pocket and the column face 22 bearing against the column of the adjoining side frame. The bottom side of the friction wedge is supported by a side spring as is conventional in the art. The angle θ is formed at the junction of the surfaces 22 and 24 and will be described in more detail hereinafter. The force P illustrated in FIGS. 4A thru 4D is the side spring force applied to the bottom of the friction wedge. The side spring and the use of such an element is conventional in the art. What has not been heretofore recognized in the art is the relationship between the force P applied by the side spring to the friction wedge and the angle θ formed between the friction surfaces of the friction wedge and that the relationship between these two parameters can be optimized for high warp friction moment and low damping force.

FIGS. 5A thru 5D show the same application of forces to the friction wedge as in FIGS. 4A thru 4D except that in this case the wedge is what is known as a split wedge such as described and claimed in U.S. Pat. No. 5,555,818 owned by Standard Car Truck Company, the assignee of the present application. The '818 patent also illustrates the conventional side spring for supporting the friction wedge and the disclosure of that patent is herein incorporated by reference.

The core of the design method begins with the three modes of friction wedge force balance. In the compression stroke mode, the column friction force is directed upward, and the normal friction force is directed downward. In the decompression stroke mode the column force is directed downward, and the normal friction force is directed upward. The compression and decompression stroke modes are the fundamental force balances for the two suspension damping stroke directions down and up respectively. In the warp action mode both friction forces are directed upward to produce the force balance effect that produces the warp friction moment.

The upward direction of the friction forces act to retain the friction wedge in the pocket against the expelling action of the vertical component of the normal force. By retaining the friction wedge in the pocket, the warp action mode allows the friction wedge to act as a very stiff connection between the side frame and bolster. For most friction wedge designs, the friction forces at the column and slope surface limit the warp action force balance to the limit of static friction. A combination of the wedge angle and the friction coefficients of the material determine this limit. As the friction wedge angle decreases, and as the coefficients increase, the limit increases exponentially to the point where the warp friction moment is infinite.

The warp action mode is generated at the friction wedge by forced changes in the yaw relationship between the bolster and side frame. Such yaw movements, which are very small in magnitude, change the angular relationship of the side frame column relative to the bolster pocket slope surface. The change in angular relationship, in turn, changes the shape of the space available for the friction wedge in such a way as to induce a squeezing action on one side of the wedge. The portion of the force balance that illustrates the squeezing action best is shown in FIGS. 4D and 5D. In the diagram, only two forces are shown: the column force, and an equivalent substitute, $R_{fi}$, for the x-direction component of the slope forces, $N_W$ and $V_{NW}$. The inboard slope reaction force, $R_{fi}$, and the column force, $C_W$, are shown in this diagram to illustrate the connection between the warp action force balance on the wedge and the warp force balances on the side frame and bolster.

Warp forces in the three-piece truck are generated in two ways, by curving and by lateral instability. In curving, opposing moments are imposed on the truck by the car body and the track as shown in the diagram of FIGS. 1, 2 and 3. At the car body interface, a turning moment is imposed on the truck at the center plate and side bearings due to the sliding friction force of truck yaw rotation. This turning moment is reacted at the track by a steering moment and an interaxle shear moment, but the steering moment is assumed to be zero to illustrate the worst case for truck warp. The remaining two moments, turning and interaxle shear, act against each other through the truck to impose a warp moment on the truck. In lateral instability, the warp action is generated on tangent track entirely by the wheel sets due to in phase steering moments generated by rolling creep forces. The warp force balance of lateral instability is not illustrated, because the effect on the friction wedges is essentially the same.

The warp moment on the truck, whether due to curving or lateral instability, is reacted by internal force couples or moments on the components of the truck. FIGS. 1 and 2 illustrate the internal warp force reaction on the friction wedge. FIG. 3 illustrates the orientation of the internal warp reaction forces generated by the warp moments illustrated in FIGS. 1 and 2. The force shown as $C_{WC}$, the critical column force, is distinguished from $C_W$, the column force, in order to illustrate at which position the force is higher and therefore the break-away point force.

A convenient method for measuring the external forces and deflections of truck warp is the truck warp table test. In this test, one axle of the truck is fixed, and the other axle is forced laterally side to side relative to the fixed axle. The warp action generated by this test is somewhat different from both the curving force balance and the lateral stability force balance, because the test force imposes a turning moment on the truck that must be balanced by the fixed axle instead of by the bolster at the center plate. As a result of the moment balance difference, the position of the critical warp force shifts from the outboard side of the wedge to the inboard side. For the purpose of determining the warp friction moment, the relationship between the warp moment and the warp action force balance on the friction wedge is not affected by differences in the force balances. For the purpose of measuring the warp friction moment the test is adequate and convenient, because the warp friction moment can be calculated directly from the input interaxle shear force by multiplying the shear force at break-away by the wheel base b. The equation developed for predicting the warp friction moment and for the math model of the invention is based on this force balance.

The two equations described herein for warp force, F, and compression damping force, $V_{cc}$, are the essential equations necessary for determining two of the fundamental parameters of the friction wedge design, spring force P and wedge angle θ. The combination of these two equations in a system of simultaneous equations determine P and θ at both empty and loaded car weight conditions. The system of equations, in turn, depends on a set of objective input parameters to find a solution. Among the input parameters, some are fixed like the "Car Weight", the "Truck Size, the "Spring Properties", the "Truck Interface Properties", and the "Wedge Friction Properties", and the others are open to some discretion like the "Wedge Configuration", and the "Suspension Damping and Capacity Ratios". Car size, truck size, and material properties predetermine the fixed parameters, so little to no discretion exists in determining these parameters. The other parameters, particularly wedge width, $W_w$, wedge rise, R, and compression damping force to sprung weight ratios, $\xi_W$, are discretionary because they can be adjusted to meet the performance requirements desired by the design engineer. There are also input parameters for load spring group selection. This section is included instead of a lumped load spring rate and height in order to account for the discrete nature of the multi-coil spring group. As a result, the side spring force and design are determined in exact proportion to the discrete load spring rate and capacity figures rather than the exact optimum figures for these parameters.

The purpose of this method is to produce the design values for a friction wedge and side spring pair such that the pair work together to yield sufficient damping and warp resistance in worn condition to maintain car stability under all standard operating conditions. As a condition of the method, the engineer must ensure that the resulting values are both manufacturable, and do not exceed reasonably acceptable levels of new car damping.

Paramter Inputs:

Car Weight: Determined by car type and load limit.

| Maximum Loaded GRL: $W_{max}$ | Minimum Empty GRL: $W_{min}$ | Unsprung Weight: $W_{US}$ | Empty Sprung Weight: $W_{S.E} = W_{min} - W_{US}$ | Loaded Sprung Weight: $W_{S.L} = W_{max} - W_{US}$ | Wheelset Weight: $W_{ws}$ | Loaded Car Dynamic Factor: $K_d$ |
|---|---|---|---|---|---|---|

Truck Size: Wedge Friction Properties: Determined by test.

| Bearing Centers: a | Wheel Base: b | Column Damping Coefficient: $\mu_{1d}$ | Slope Damping Coefficient: $\mu_{2d}$ | Column Warp Coefficient – Max: $\mu_{1w}$ | Slope Warp Coefficient – Max: $\mu_{2w}$ |
|---|---|---|---|---|---|

Wedge Configuration: Determined by available space, and material/weight conservation criteria.

| Wedge Width: $w_w$ | Max. Wedge Height: $h_{w.max}$ | Wedge Height Upper Edge: $h_{ue}$ | Wedge Height Lower Edge: $h_{le}$ | Wedge Rise: R | Side Spring To Column: $h_{cs}$ | Wedge Toe Height: $h_{wt}$ |
|---|---|---|---|---|---|---|

Side Spring Properties: Determined by standard spring material properties.

| Modulus of Elasticity: G | $G_c$ | Corrected Solid Stress: $\tau$ |
|---|---|---|

Truck Interface Properties: Determined by worst case conditions.

| Center Plate Coefficient: $\mu_{cp}$ | Center Plate Radius: $r_{cp}$ | Pedestal Coefficient: $\mu_p$ | Pedestal Moment Arm: $r_p$ |
|---|---|---|---|
| Side Bearing Coefficient: $\mu_{sb}$ | Side Bearing Point Radius: $r_{sb}$ | Side Bearing Max Load: $P_{sb.L}$ | Empty Car Rail Coefficient: $\mu_r$ |

Suspension Damping and Capacity Ratios: Determined by maximum and minimum allowed damping G forces.

| Compression Damping Force to Sprung Weight Ratios - Worn - Empty - Loaded: $\xi_{c.W.E}$ $\xi_{c.W.L}$ | Reserve Capacity Worn: $RC_W$ | Note: The damping force to sprung weight ratio equals the acceleration in g's necessary to break the static friction force, and produce movement across the suspension. |
|---|---|---|

Load Spring Suspension Design: Determined by desired spring travel and Reserve Capacity.

| Outer Load Spring: Quantity: $n_{os}$ | Free Height: $h_{os.f}$ | Spring Rate: $s_{os}$ | Inner Load Spring: Quantity: $n_{is}$ | Free Height $h_{is.f}$ | Spring Rate: $s_{is}$ |
|---|---|---|---|---|---|

| Third Load Spring: Quantity: Unknown | Free Height: $h_{ts.f}$ | Spring Rate: $s_{ts}$ | Solid Spring Height: $h_s$ |
|---|---|---|---|

Required Damping and Warp Friction Force - Worn Condition:

Compression Damping Force - Worn - Loaded:

$$V_{c.W.L} = \xi_{c.W.L} \cdot \frac{W_{S.L}}{4}$$

Compression Damping Force - Worn - Empty:

$$V_{c.W.E} = \xi_{c.W.E} \cdot \frac{W_{S.E}}{4}$$

Max. Truck Turning Moment - Worn - Loaded:

$$Mt_{W.L} = \frac{W_{max}}{2} \cdot \mu_{cp} \cdot r_{cp} + 2 \cdot P_{sb.L} \cdot \mu_{sb} \cdot r_{sb} \cdot K_d$$

Required Warp Friction Force - Worn - Loaded:

$$F_{W.L} = \frac{Mt_{W.L}}{b}$$

Required Warp Friction Force - Worn - Empty:

$$F_{W.E} = \frac{W_{min}}{4} \cdot \mu_r$$

Pedestal Warp Friction Force - Worn - Loaded:

$$Fp_{W.L} = \frac{\frac{W_{max} - W_{ws}}{8} \cdot \mu_p \cdot r_p}{b}$$

Pedestal Warp Friction Force - Worn - Empty:

$$Fp_{W.E} = \frac{\frac{W_{max} - W_{ws}}{8} \cdot \mu_p \cdot r_p}{b}$$

Maximum Warp Friction Force -Worn - Loaded:
$Fw_{W.L} = F_{W.L} - Fp_{W.L}$

Maximum Warp Friction Force - Worn -Empty:
$Fw_{W.E} = F_{W.E} - Fp_{W.E}$

Maximum Warp Friction Moment - Worn - Loaded:
$M_{W.L} = F_{W.L} \cdot b = Mt_{W.L.}$ Maximum Warp Friction Moment - Worn - Empty:
$M_{W.E} = F_{W.E} \cdot b$ Wedge Angle and Spring Force - Empty Car:

Given The System of Equations:
Wedge Warp Friction Force - Empty:

$$Fw_{W.E} = \frac{-P}{2} \cdot \frac{(\cos(\theta) + \mu_{2w} \cdot \sin(\theta))}{(\mu_{1w} \cdot \cos(\theta) + \mu_{1w} \cdot \mu_{2w} \cdot \sin(\theta) + \mu_{2w} \cdot \cos(\theta) - \sin(\theta))} \cdot \frac{2 \cdot a \cdot w_w}{[b \cdot (a + w_w)]}$$

Maximum Compression Damping Force Per Suspension - Empty:

$$V_{c.W.E} = 2 \cdot \mu_{1d} \cdot P \cdot \frac{(\cos(\theta) + \mu_{2d} \cdot \sin(\theta))}{(-\mu_{1d} \cdot \cos(\theta) + \mu_{1d} \cdot \mu_{2d} \cdot \sin(\theta) + \mu_{2d} \cdot \cos(\theta) + \sin(\theta))}$$

-continued

| | |
|---|---|
| Find The Empty Car Spring Force And Wedge Angle: | |
| X = Find(P, θ) | |
| Empty Car Wedge Spring Force: | Empty Car Wedge Angle: |
| $P_{ss.w.E} = X_0$ | $\theta_E = X_1$ |

The analytical results of this design method have shown that for maximized warp resistance and minimized damping, the ideal conditions for the most efficient truck operation, the angle θ of the friction wedge, whether it be a single wedge or what is known as a split wedge be from between 28° to about 32°. This is generally a smaller wedge angle than has been heretofore used in damping systems of the type shown herein. For the most efficient damping, but to some extent dependent upon the parameters of the car, the force P should be between approximately 1,350 lbs. to approximately 7,300 lbs. Within this range, and depending upon car size, type and loading, there may be variation but the side spring load should be between the values set forth.

Whereas the preferred form of the invention has been shown and described herein, it should be realized that there may be many modifications, substitutions and alterations thereto.

What is claimed is:

1. A damping system for a rail car truck having a bolster, a pair of side frames, a plurality of friction wedges damping relative movement between the bolster and the side frames, and a side spring supporting each friction wedge, each friction wedge having a generally triangular shape with an angle θ being defined between a vertical friction surface and a sloping friction surface, the angle θ and the force P of each side spring being defined by the equations $$Fw_{W.E} = \frac{-P}{2} \cdot \frac{(\cos(\theta) + \mu_{2w} \cdot \sin(\theta))}{(\mu_{1w} \cdot \cos(\theta) + \mu_{1w} \cdot \mu_{2w} \cdot \sin(\theta) + \mu_{2w} \cdot \cos(\theta) - \sin(\theta))} \cdot \frac{2 \cdot a \cdot w_w}{[b \cdot (a \cdot w_w)]}$$

-continued $$V_{c.W.E} = 2 \cdot \mu_{1d} \cdot P \cdot \frac{(\cos(\theta) - \mu_{2d} \cdot \sin(\theta))}{(-\mu_{1d} \cdot \cos(\theta) + \mu_{1d} \cdot \mu_{2d} \cdot \sin(\theta) + \mu_{2d} \cdot \cos(\theta) + \sin(\theta))}$$

where:

$Fw_{W.E}$ is the required warp friction force—worn—empty;

$\mu_{2w}$ is the slope warp coefficient—max;

$\mu_{1w}$ is the column warp coefficient—max;

a is the bearing centers;

b is the wheelbase;

$W_w$ is the wedge;

$V_{c/W.E}$ is the maximum compression damping force per suspension—empty;

$\mu_{1d}$ is the column damping coefficient;

$\mu_{2d}$ is the slope damping coefficient.

2. The damping system of claim 1 wherein the angle θ varies between 28° and 32°.

3. The damping system of claim 2 wherein the force P varies between about 1,350 lbs. and about 7,300 lbs.

4. The damping system of claim 1 wherein the bolster has a pair of pockets at each end thereof, with each pocket facing a column of a side frame, there being a friction wedge in each pocket.

5. The damping system of claim 4 wherein each friction wedge is a single wedge element.

6. The damping system of claim 4 wherein each friction wedge consists of two symmetrical wedge halves.

* * * * *

UNITED STATES PATENT AND TRADEMARK OFFICE

CERTIFICATE OF CORRECTION

PATENT NO. : 6,688,236 B2
DATED : February 10, 2004
INVENTOR(S) : Armand P. Taillon It is certified that error appears in the above-identified patent and that said Letters Patent is hereby corrected as shown below:

Column 9,
Line 1, replace “Paramter” with -- Parameter --.

Column 12,
Line 22, replace “$W_w$ is the wedge;” with -- $W_w$ is the wedge width; --

Signed and Sealed this

Twenty-fourth Day of May, 2005

JON W. DUDAS
*Director of the United States Patent and Trademark Office*